US005409357A

United States Patent [19]

Yu et al.

[11] Patent Number: 5,409,357

[45] Date of Patent: Apr. 25, 1995

[54] IMPELLER FOR ELECTRIC AUTOMOTIVE FUEL PUMP

[75] Inventors: Dequan Yu; Henry W. Brockner, both of Ann Arbor, Mich.

[73] Assignee: Ford Motor Company, Dearborn, Mich.

[21] Appl. No.: 161,629

[22] Filed: Dec. 6, 1993

[51] Int. Cl.[6] ..... F04B 17/00

[52] U.S. Cl. ..... 417/423.1; 415/55.1

[58] Field of Search ..... 417/423.3, 423.1, 410.1, 417/366; 415/55.1, 55.2

[56] References Cited

U.S. PATENT DOCUMENTS

| | | | |
|---|---|---|---|
| 2,724,338 | 11/1955 | Roth | 415/55.5 |
| 2,842,062 | 7/1958 | Wright | 415/11 |
| 3,374,744 | 3/1968 | Toma | 415/55.1 |
| 3,536,412 | 10/1970 | Beare | 415/55.1 |
| 3,973,865 | 8/1976 | Mugele | 415/53 T |
| 4,006,998 | 2/1977 | Schonwald | 415/213 T |
| 4,141,674 | 2/1979 | Schonwald | 416/223 A |
| 4,194,798 | 3/1980 | Schonwald et al. | 415/55.1 |
| 4,204,802 | 5/1980 | Schonwald et al. | 415/55.1 |
| 4,403,910 | 9/1983 | Watanabe et al. | 415/53 T |
| 4,591,311 | 5/1986 | Matsuda et al. | 415/55.5 |
| 4,822,258 | 4/1989 | Matsuda et al. | 417/423.3 |
| 4,834,612 | 5/1989 | Lahn et al. | 415/55.1 |
| 4,938,659 | 7/1990 | Bassler | 415/55.1 |
| 4,943,208 | 7/1990 | Schoenwald | 415/175 |
| 4,992,022 | 2/1991 | Aust et al. | 415/55.1 |
| 5,011,367 | 4/1991 | Yoshida et al. | 415/55.1 |
| 5,096,386 | 3/1992 | Kassel | 417/69 |
| 5,160,249 | 11/1992 | Iwai et al. | 415/55.1 |
| 5,257,916 | 11/1993 | Tuckey | 417/423.3 |
| 5,310,308 | 5/1994 | Yu et al. | 415/55.6 |

OTHER PUBLICATIONS

Modern Plastics Encyclopedia, 1989, p. 133, Schleckser and Clarke.

*Primary Examiner*—Richard A. Bertsch
*Assistant Examiner*—Peter Korytnyk
*Attorney, Agent, or Firm*—David B. Kelley; Roger L. May

[57] ABSTRACT

A fuel pump has a motor with a shaft extending therefrom and an impeller fitted thereon for pumping fuel from a fuel tank to an internal combustion engine. A pumping chamber, which encases the impeller, is comprised of a cover channel and a bottom channel formed in a pump cover and a pump bottom, respectively. The impeller has a plurality of radially extending vanes on an outer circumference separated by partitions of shorter radial length. The partitions are comprised of quarter-circle shaped arcuate portions extending from the outer circumference of the impeller to a straight portion having parallel sides, which preferably extend approximately 0.1 millimeters to 0.5 millimeters, to a flat top with rounded corners. Fluid active vane grooves thus formed circumferentially between the vanes and axially between the partitions which reduce fuel vortices angular acceleration within the pumping chamber thus increasing pump efficiency.

19 Claims, 2 Drawing Sheets

IMPELLER FOR ELECTRIC AUTOMOTIVE FUEL PUMP

FIELD OF THE INVENTION

The present invention relates to automotive fuel pumps, and, more particularly, to a regenerative turbine type rotary pumping element or impeller with vane partitions radially shorter than the vane.

BACKGROUND OF THE INVENTION

Regenerative turbine fuel pumps for automobiles typically operate by having a rotary pumping element, for example an impeller, fitted to a motor shaft within a pump housing. The pump housing is formed of two halves, including a pump cover and a pump bottom, which cooperate to form a pumping chamber around the outer circumference of the impeller. Vanes on an outer circumference of the impeller pump fuel as the shaft rotates and primary vortices are formed within the pumping chamber. The shape of the primary vortices, which effects pumping efficiency, is partially determined by the shape of vane grooves and partitions formed between individual vanes. Conventional electric automotive fuel pumps employ regenerative turbine impellers having vanes separated by partitions of the same height. FIG. 5 shows such an impeller 100 having vanes 102 and partitions 104 separating vane grooves 106. Partitions 104 extend so that they are flush with vanes 102. As the impeller rotates, vortices 108 rotate in pumping chamber 110 and are routed by partitions 104 toward pumping chamber top 110', and abruptly changing direction by 90°, resulting in pumping losses and decreased pump efficiency.

DESCRIPTION OF THE PRIOR ART

Several U.S. Patents, including U.S. Pat. Nos. 2,842,062 (Wright), 5,011,367 (Yoshida), and 4,403,910 (Watanabe, et al.), disclose pump impellers having fluid active surfaces with curved root portions and radial linear partitions which extend outwardly so as to be flush with the impeller outer periphery. These impellers are similar to that shown in FIG. 5 and have the same drawbacks as discussed above.

Gaseous regenerative turbine type impellers having rectangular blades between which are located shortened, arcuately shaped fluid reactive surfaces which cause fluid to move radially out from the impeller periphery are shown in U.S. Pat. Nos. 4,141,674 (Schonwald), 3,973,865 (Mugele), and 4,943,208 (Schonwald). The impellers in these disclosures do not have, however, the advantageous linear partition portion of the present invention.

SUMMARY OF THE INVENTION

The present invention provides a fuel pump for supplying fuel to an automotive engine from a fuel tank, with the fuel pump comprising a pump housing, a motor mounted within the housing and having a shaft extending therefrom, and a casing for a rotary pumping element, such as an impeller. The casing has a pump bottom mounted within the pump housing with a bore through which the shaft extends, along with a bottom channel portion of an annular pumping chamber having a fuel outlet at an end thereof. An impeller is fitted to the shaft and has a plurality of spaced-apart, radially outwardly extending vanes around an outer circumference of the impeller with a plurality of partitions interposed therebetween. The partitions do not extend radially outward as far as the vanes, and, preferably, extend approximately half the radial distance from the radially innermost point of the vanes to the radially outermost point of the vanes. The partitions are comprised of an arcuate portion on either side of a straight portion, with the straight portion extending radially outward from the arcuate portions and having a flat top with rounded corners. The arcuate portions are quarter-circle shaped surfaces beginning at a radial innermost root portion of the partitions. Thus, the partitions and vanes define a plurality of fluid active, arcuately shaped vane grooves which cause fuel to move outwardly from the impeller. A pump cover, which has a cover channel portion of an annular pumping chamber with a pump inlet, is mounted on an end of the housing and is attached to the pump bottom with the impeller therebetween such that the pump cover and pump bottom cooperate to form a complete pumping chamber for the impeller.

In the preferred embodiment, the partitions have sides parallel to a plane perpendicular to the shaft extending radially outward between approximately 0.1 millimeters and 0.5 millimeters from the radially outermost portion of the arcuate shaped portions. The impeller is preferably symmetrical about a plane through the impeller and perpendicular to the shaft, and is injection molded of a phenolic plastic composite material. The fuel pump may be mounted within the fuel tank of the automobile. In an alternative embodiment, the impeller has a ring portion around an outer circumference thereof connected to the plurality of vanes such that a plurality of axially extending fuel flow passages are formed between the vanes, the partitions, and the ring portion.

It is therefore an object of the present invention to provide a fuel pump having a rotary pumping element with radially shorter vane partitions relative to the vanes.

Another object of the present invention is to provide a fuel pump having quarter-circle shaped impeller grooves to better form fuel vortices within a pumping chamber surrounding the rotary pumping element.

A further object is to provide a fuel pump rotary pumping element with straight projections from the quarter-circle grooves in the pumping element to stabilize vortices flow and reduce pumping losses.

DETAILED DESCRIPTION OF THE PREFERRED EMBODIMENTS

Figure 1:
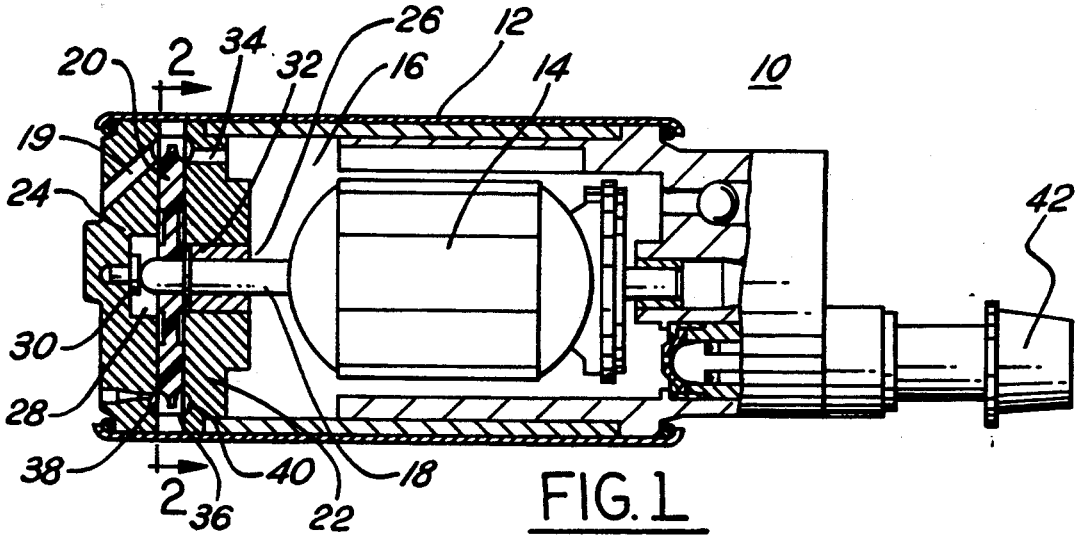
FIG. 1 is a cross-sectional view of a fuel pump according to the present invention.

Referring now to FIG. 1, fuel pump 10 has housing 12 for containing its inner components. Motor 14, preferably an electric motor, is mounted within motor space 16 for rotating shaft 18 extending therefrom toward fuel inlet 19 at the left of fuel pump 10 in FIG. 1. A rotary pumping element, preferably an impeller 20, is fitted on shaft 18 and encased within pump bottom 22 and pump cover 24. Impeller 20 has a central axis which is coincident with the axis of shaft 18. Shaft 18 passes through a shaft opening 26 in pump bottom 22, through impeller 20, into cover recess 28, and abuts thrust button 30. Shaft 18 is journalled within bearing 32. Pump bottom 22 has a fuel outlet 34 leading from a pumping chamber 36 formed along the periphery of impeller 20 by an annular cover channel 38 of pump cover 24 and an annular bottom channel 40 of pump bottom 22. Pressurized fuel is discharged through fuel outlet 34 to motor space 16 and cools motor 14 while passing over it to pump outlet 42 at an end of pump 10 axially opposite fuel inlet 44.

Figure 2:
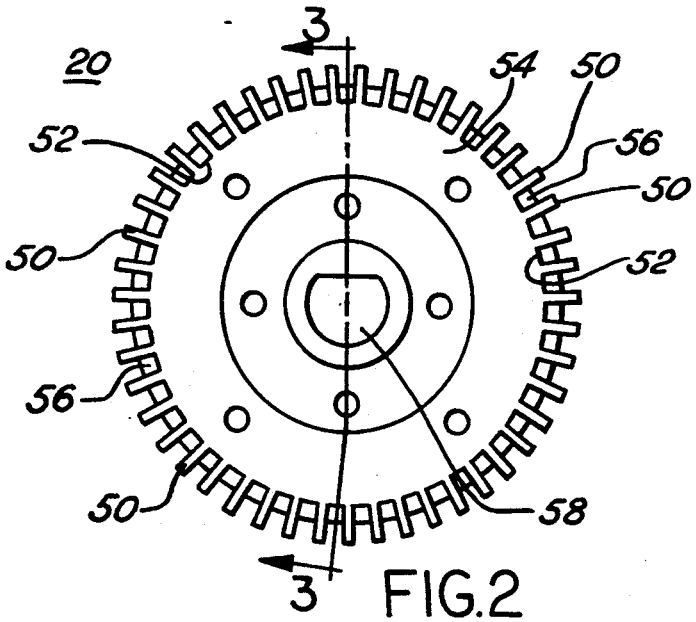
FIG. 2 is a sectional view along line 2—2 of FIG. 1 showing a rotary pumping element according to the present invention.
Figure 3:
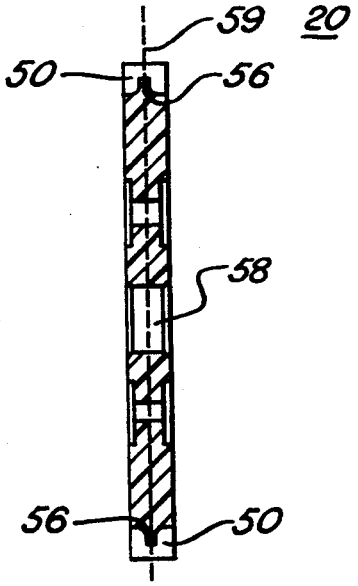
FIG. 3 is a sectional view along line 3—3 of the rotary pumping element of FIG. 2 showing a pumping vane with vane grooves separated by a radially shortened partition.

FIG. 2 shows a sectional view of impeller 20 along line 2—2 of FIG. 1. Vanes 50 extend radially outward from outer circumference 52 of impeller face 54. Partitions 56, which circumferentially separate vanes 50 and are interposed therebetween, extend outwardly from outer circumference 52 a radially shorted distance than vanes 50. Bore 58 is formed so that impeller 20 can be slip fit to shaft 16. FIG. 3 is a side view of impeller 20 along line 3—3 of FIG. 2. Impeller 20 is preferably symmetrical about axis 59 which is perpendicular to shaft 16 and has an outer diameter of between 35 millimeters and 40 millimeters, preferably approximately 38 millimeters.

Figure 4:
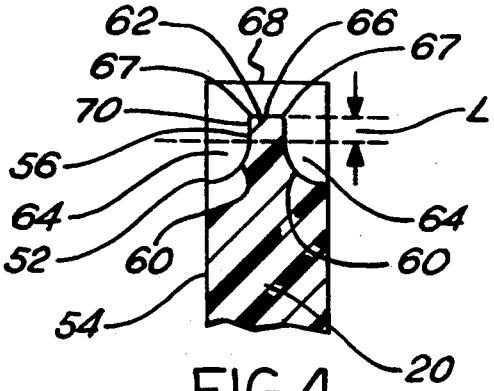
FIG. 4 is a partial cross-sectional view of a rotary pumping element according to the present invention showing a vane separating partition comprised of arcuate shaped sections on either side of a straight section radially shorter than the vane.
Figure 5:
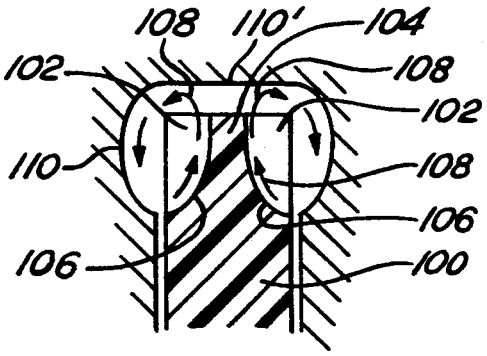
FIG. 5 (PRIOR ART)
FIG. 5 is a cross-sectional view of a prior art impeller within a pumping chamber showing a partition circumferentially flush with the vane and separating the vane grooves.

A detailed partial cross-sectional view of an outer circumferential portion of impeller 20 through a partition 56 is shown in FIG. 4. Vane 50, which preferably is rectangular shaped, adjoins partition 56. Partition 56 comprises arcuate shaped sections 60 on either side of straight section 62 which extends radially outward from arcuate shaped sections 60 and which is radially shorter than vane 50. Straight section 62 preferably has flat top 66 approximately parallel with the radially outermost edge 68 of vane 50. Flat top 66 also has rounded corners 67. Arcuate sections 60 begin at outer circumference 52 of impeller face 54 and preferably are quarter-circle shaped. Straight section 62 has parallel sides 70 which extend a distance L radially outward from arcuate sections 60, as seen in FIG. 4. Preferably, distance L is between approximately 0.1 millimeters and 0.5 millimeters. Partition 56 preferably extends approximately half the distance between outer circumference 52 of impeller face 54 and outermost edge 68 of vane 50. Vane grooves 64 are thus axially separated by partition 56.

Figure 6:
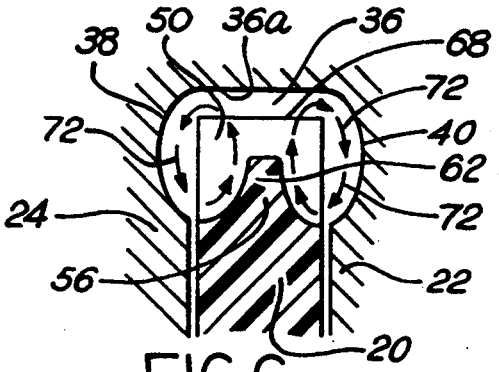
FIG. 6 is a cross-sectional view of an impeller according to the present invention showing a radially shortened vane partition optimally shaping vortices within the pumping chamber.

FIG. 6 shows an impeller 20 as just described situated within pump cover 24 and pump bottom 22. As impeller 20 rotates, vortices 72 are formed in annular cover channel 38 and annular bottom channel 40 of pumping chamber 36. Since shortened straight portion 62 of impeller 20 increases the distance between partition 56 and pumping chamber upper wall 36*a*, it is believed that the angular acceleration of vortices 72 near annular cover channel 38 and annular bottom channel 40 is reduced, as is the size of low-velocity zones (eddy currents) near vane outer circumference 68 of impeller 20. Studies have shown that with the impeller 20 design described above, pump 10 efficiency increases nearly 10%.

Figure 9:
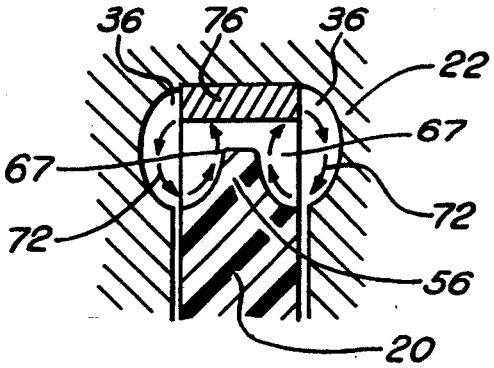
FIG. 9 is a cross-sectional view of an impeller according to an alternative embodiment of the present invention showing a circumferential ring portion and a radially shortened vane partition to better shape vortices within the pumping chamber.
Figure 7:
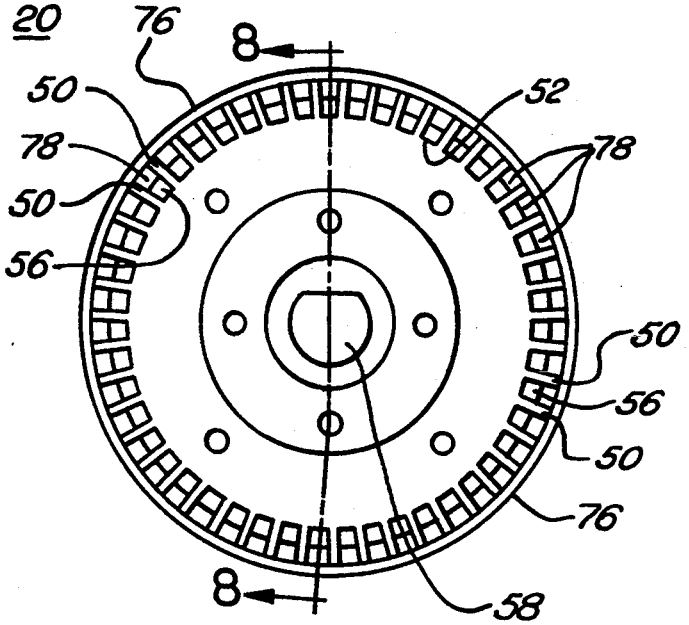
FIG. 7 is a sectional view along line 2—2 of FIG. 1 showing a rotary pump according to an alternative embodiment of the present invention showing a radially outer ring portion connected to the pumping element vanes.
Figure 8:
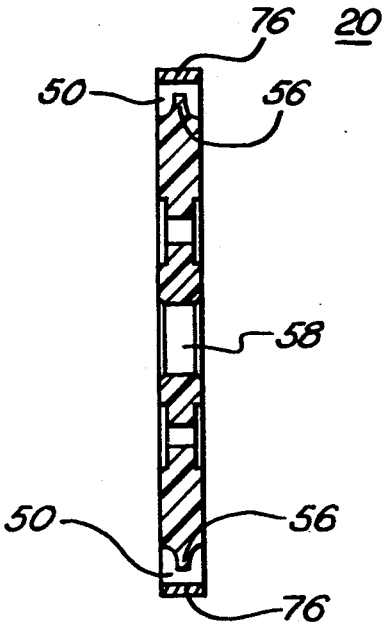
FIG. 8 is a sectional view along line 8—8 of FIG. 7 showing a rotary pumping element according to an alternative embodiment of the present invention showing a pumping vane with vane grooves separated by a shortened partition and having an radially outer circumferential ring portion.

In an alternative embodiment shown in FIG. 7, impeller 20 has a ring portion 76 around an outer circumference 52 thereof connected to vanes 50. FIG. 8 shows a side view of the alternative embodiment of impeller 20 along line 8—8 of FIG. 7. Ring portion 76 fits snugly within pumping chamber 36, as seen in FIG. 9, so that pump bottom 22 does not require a stripper portion (not shown), as is required in conventional fuel pumps employing regenerative turbine type impellers. A plurality of axially extending fuel flow passages 78 are formed between vanes 50, partitions 56, and ring portion 76.

Impeller is preferably injection molded out of a plastic material, such as phenolic, acetyl or other plastic or non-plastic materials known to those skilled in the art and suggested by this disclosure. Alternatively, impeller 20 can be die cast in aluminum or steel.

Fuel pump 10 can be mounted within the fuel tank (not shown) or, alternatively, can be mounted in-line.

Although the preferred embodiment of the present invention has been disclosed, various changes and modifications may be made without departing from the scope of the invention as set forth in the appended claims.

We claim:

1. A fuel pump for supplying fuel to an automotive engine from a fuel tank, the fuel pump comprising:

a pump housing;

a motor mounted within said housing and having a shaft extending therefrom;

a pump bottom mounted within said housing having a bore through which said shaft extends;

a rotary pumping element fitted to said shaft and having a plurality of radially outwardly extending vanes around an outer circumference of said pumping element with a plurality of partitions interposed therebetween extending a radially shorter distance than said vanes, said partitions and said vanes defining a plurality of arcuately shaped vane grooves;

a ring portion fitted around an outer circumference of said rotary pumping element connected to said plurality of vanes such that a plurality of extending fuel flow passages are formed between said vanes, said partitions, and said ring portion; and a pump cover mounted on an end of said housing and attached to said pump bottom with said rotary pumping element therebetween, said pump cover and said pump bottom cooperating to form a complete pumping chamber for said rotary pumping element.

2. A fuel pump according to claim 1 wherein said plurality of partitions extend approximately half the radial distance as said vanes from the outer circumference of a face of said rotary pumping element.

3. A fuel pump according to claim 2 wherein said partitions are comprised of an arcuate portion on either side of a straight portion, said straight portion extending radially outward from said arcuate portions and having a flat top with rounded corners.

4. A fuel pump according to claim 3 wherein said arcuate portions are quarter-circle shaped, fluid active surfaces beginning at the outer circumference said face of said rotary pumping element.

5. A fuel pump according to claim 3 wherein said straight portions have sides parallel to said face of said rotary pumping element, said sides extending radially outward between approximately 0.1 millimeters and 0.5 millimeters from said the radially outermost portion of said arcuate shaped portions.

6. A fuel pump according to claim 1 wherein said rotary pumping element is symmetrical about a plane through said pumping element and perpendicular to said shaft.

7. A fuel pump according to claim 1 mounted within said fuel tank.

8. A fuel pump according to claim 1 wherein said rotary pumping element is injection molded of a phenolic plastic composite material.

9. A fuel pump for supplying fuel to an automotive engine from a fuel tank, the fuel pump comprising:

a pump housing;

a motor mounted within said housing and having a shaft extending therefrom;

a pump bottom mounted within said housing having a bore through which said shaft extends, said pump bottom also having a bottom channel portion of an annular pumping chamber with a fuel outlet at an end thereof;

an impeller fitted to said shaft and having a plurality of spaced-apart, radially outwardly extending vanes around an outer circumference of said impeller with a plurality of partitions interposed therebetween extending approximately half the radial distance from the radially innermost point of said vanes to the radially outermost point of said vanes, said partitions comprised of an arcuate portion on either side of a straight portion having parallel sides, said straight portion extending radially outward from said arcuate portions and having a flat top with rounded corners and said arcuate portions being quarter-circle shaped surfaces beginning at a radial innermost root portion of said partitions, said partitions and said vanes defining a plurality of fluid active, arcuately shaped vane grooves; and a pump cover mounted on an end of said housing and attached to said pump bottom with said rotary pumping element therebetween and having a cover channel portion of an annular pumping chamber with a pump inlet, said pump cover and pump bottom cooperating to form a complete pumping chamber for said rotary pumping element.

10. A fuel pump according to claim 9 wherein said partition has sides parallel to a plane perpendicular to said shaft, said sides extending radially outward between approximately 0.1 millimeters and 0.5 millimeters from said the radially outermost portion of said arcuate shaped portions.

11. A fuel pump according to claim 9 wherein said impeller is symmetrical about a plane through said impeller and perpendicular to said shaft.

12. A fuel pump according to claim 9 mounted within said fuel tank.

13. A fuel pump according to claim 9 wherein said impeller is injection molded of a phenolic plastic composite material.

14. A fuel pump according to claim 9 wherein said impeller has a ring portion around an outer circumference thereof connected to said plurality of vanes such that a plurality of axially extending fuel flow passages are formed between said vanes, said partitions, and said ring portion.

15. A fuel pump for supplying fuel to an automotive engine from a fuel tank, the fuel pump comprising:

a pump housing;

a motor mounted within said housing and having a shaft extending therefrom;

a pump bottom mounted within said housing having a bore through which said shaft extends, said pump bottom also having a bottom channel portion of an annular pumping chamber with a fuel outlet at an end thereof;

an impeller fitted to said shaft and having a plurality of spaced-apart, radially outwardly extending vanes around an outer circumference of said impeller with a plurality of partitions interposed therebetween extending approximately half the radial distance from the radially innermost point of said vanes to the radially outermost point of said vanes, said partitions comprised of an arcuate portion on either side of a straight portion, said straight portion extending radially outward from said arcuate portions and having a flat top with rounded corners and said arcuate portions being quarter-circle shaped surfaces beginning at a radial innermost root portion of said partitions, said partitions and said vanes defining a plurality of fluid active, arcuately shaped vane grooves;

a ring portion filled around an outer circumference of said impeller connected to said plurality of vanes such that a plurality of axially extending fuel flow passages are formed between said vanes, said partitions, and said ring portion; and a pump cover mounted on an end of said housing and attached to said pump bottom with said rotary pumping element therebetween and having a cover channel portion of an annular pumping chamber with a pump inlet, said pump cover and pump bottom cooperating to form a complete pumping chamber for said rotary pumping element.

16. A fuel pump according to claim 15 wherein said straight portion has sides parallel to a plane perpendicular to said shaft, said sides extending radially outward between approximately 0.1 millimeters and 0.5 millimeters from said the radially outermost portion of said arcuate shaped portions.

17. A fuel pump according to claim 15 wherein said impeller is symmetrical about a plane through said impeller and perpendicular to said shaft.

18. A fuel pump according to claim 15 mounted within said fuel tank.

19. A fuel pump according to claim 15 wherein said impeller is injection molded of a phenolic plastic composite material.

* * * * *